United States Patent [19]

Nissen

[11] Patent Number: 5,033,133

[45] Date of Patent: Jul. 23, 1991

[54] SEAT CUSHION

[75] Inventor: George P. Nissen, Cedar Rapids, Iowa

[73] Assignee: Nissen Sports Academy, Inc., Stone City, Iowa

[21] Appl. No.: 582,391

[22] Filed: Sep. 13, 1990

[51] Int. Cl.[5] ..... A47C 7/18; A47C 27/14

[52] U.S. Cl. ..... 5/450; 5/441

[58] Field of Search ..... 5/420, 436, 441, 450, 5/468

[56] References Cited

U.S. PATENT DOCUMENTS

| | | | |
|---|---|---|---|
| 2,819,712 | 1/1958 | Morrison | 5/450 X |
| 3,017,642 | 1/1962 | Rosenberg et al. | 5/450 X |
| 3,864,766 | 2/1975 | Prete, Jr. | 5/450 X |
| 3,872,525 | 3/1975 | Lea et al. | 5/450 |
| 4,149,919 | 4/1979 | Lea et al. | 5/450 |
| 4,190,918 | 3/1980 | Harvell | 5/420 X |
| 4,925,241 | 5/1990 | Geraci | 5/420 X |

FOREIGN PATENT DOCUMENTS

| | | | |
|---|---|---|---|
| 984604 | of 1905 | United Kingdom | 5/450 |

*Primary Examiner*—Michael F. Trettel

*Attorney, Agent, or Firm*—Simmons, Perrine, Albright & Ellwood

[57] ABSTRACT

A seat cushion features an inner core of an open-celled compressible foam material hermetically sealed within a first inner cover which is of a size to fit loosely about the inner core. An outer cover is of a size and shape substantially as that of the inner core and is nominally larger to allow the material of the inner cover to shift within the space between the inner core and the outer cover. A tube incorporating a valve leads from the space within the inner cover through the covers to the atmosphere. The cushion is naturally self-inflating when the valve is open so need not be blown up by the user with this or her lungs or other air source. A sitter on the cushion can adjust its compressibility by opening the valve, or deflate the cushion entirely for storage or for portability, then close the valve to maintain the cushion deflated.

15 Claims, 1 Drawing Sheet

SEAT CUSHION

BACKGROUND OF THE INVENTION

This invention concerns seat cushions, particularly seat cushions for use at athletic and other events.

So far as is known, most seat cushions, especially portable, individual ones used in athletic stadia, are made of some compressible core material or materials enclosed in a cover. These cushions compress to more or less degree depending on the nature of the core material and on the weight of the sitter. But it is not possible for a sitter to adjust the compressibility of such cushions or to collapse them for storage or allow them to be carried more conveniently, for instance. Other seat cushions are inflatable, by means of an air pump or other artificial air source, or, much more commonly, by the breath of the user. In those types the air is forced into a flexible enclosure through a conduit incorporating a valve to retain the air. The compressibility of these cushions can be adjusted by varying the amount of the air blown into the cushion and by the valve. The latter also allows collapse of the cushion for storage or transport.

The chief object of the invention, however, is a compressible seat cushion, especially for athletic and other events, which is self inflating and compressibly adjustable by the sitter, and which can be deflated by the sitter for storage, all without the need of an air pump or other air source, such as the lungs of the user.

Another object of the invention is a compressible seat cushion which can be fashioned simply and with relatively inexpensive materials.

DISCUSSION AND SUMMARY OF THE INVENTION

Essentially, and as a general concept, the objects of the invention may be achieved by the use of a compressible, open-celled core material, such as an open pore foam material, normally filled with air, and an air-tight cover enclosing the core material. A tube incorporating a valve outside the cover leads from the atmosphere through the cover into the core.

When the valve is open the cushion is fully "inflated" because, owing to the nature of the core material, its cellular structure is normally and naturally full of air. If the valve is then closed, no air can escape from the core so that when one sits on the cushion, the weight of the latter compresses the core material until the pressure of the air within rises to equal that of the pressure thereon. If the cushion is then not "soft" enough, the valve can be opened to expel as much air as desired and then closed. For storing or carrying the cushion after use, re-opening the valve while still sitting on the cushion will allow substantially all the air to be expelled, after which the valve is closed. The sitter can then stand up, pick up the deflated cushion and fold it up for transport. To reinflate the cushion, all that is necessary is to re-open the valve. The core then automatically refills with air. The valve is then closed again.

In seeking to implement the invention as summarized above, it was found that certain particular embodiments thereof showed advantages and solved problems which some other embodiments in accordance with the general concept did not show or were not capable of solving. For example, in utilizing an open pore foam to provide a core or body structure for the cushion, it is realized immediately that the pressure of a sitter on the cushion collapses the cushion, unless the air captured within the volume of the initially expanded foam is not retained at the outer bounds of the cushion.

A solution comes to mind according to which the inner foam cushion is encased within an air tight rubber-type cover or outer shell. Such a shell appears to provide a suitable solution to air escaping from the open pore foam core when a person is seated on the cushion. However, when a comparatively heavy person, as persons go, uses the cushion, a resiliently yielding cover of a relatively thin gauge wall thickness tends to bulge outwards laterally from the person's seating area and, in turn, also tends to yield and compress the foam in places where counterpressure for comfortable seating may be desirable. With increasing thickness of the air-tight cover the described disadvantage is lessened. At the same time rigidity and weight of the outer rubber cover increase, lessening the comfort and usefulness of the cushion particularly for people of smaller frame.

Also, a resiliently structured shell fitting tightly about the contour of the cushion was seen as having another subtle, but unfortunate result. In that the resiliency of the air-tight outer cover tends to counteract to the outward resiliency of the shape of the open pore foam core giving force to the expansion process when the valve to the outer cover is opened, the outer cover in effect slows or impedes the self-inflating process of the cushion.

Thus, it is found to be desirable to have a cushion which allows the inner foam core to expand without being impeded when the valve is opened. At the same time it is also desirable to provide a relatively nonyielding outer shape to the cushion when the cushion core is allowed to inflate to its fullest. It is further desirable to maintain both of the above characteristics with a cushion that weighs optimally little.

A strong, yet easily self-inflatable cushion was obtained in particular embodiments of the above invention in which the open pore foam core of the cushion was encased with a first, flexible, air-tight, thin gauge inner cover including an attached tubular extension with a closable opening capable of providing an air passage, when open, between the atmosphere and the inner space of the cover, and a second, flexible yet non-yieldable outer cover of a size and shape substantially of that of the cushion and disposed about the first inner cover of the core, the tubular extension extending through the outer cover. In the preferred embodiment of the invention, it was found to be particularly advantageous to size the inner cover to be larger than the outer cover of the cushion. Thus, the inner cover is disposed in numerous folds about the core of the cushion and within the outer cover.

It has been found that when a person sits unevenly on the cushion, or the cushion, being less than fully inflated is stepped on, a tightly fitting inner cover is subjected to stresses. In that the inner cover material is of a thin gauge and is for the reasons shown desirably not of a resiliently yielding material, local stresses from being stepped no, for example, may permanently damage the inner cover and destroy its air-tight characteristic. Allowing the inner cover to fit loosely within the outer cover, instead eliminates such local stresses in that the excess material of the inner cover extends and moves against the inner surface of the outer cover without being stressed further.

In a particular, preferred embodiment of the invention, the outer cover is an impregnated nylon weave, having rip-stop characteristics and being essentially water proof. Seams of the outer cover need not be air-tight. This is an important advantage of the invention in that the preferred material of the outer cover may be exchanged for another type material which is not water proof and which may, hence, be considered more comfortable by persons who may remain seated on the cushion for prolonged periods of time.

Other features and advantages of the invention will become apparent from the drawings and the more detailed description which follow:

DETAILED DESCRIPTION OF A PREFERRED EMBODIMENT

Figure 1:
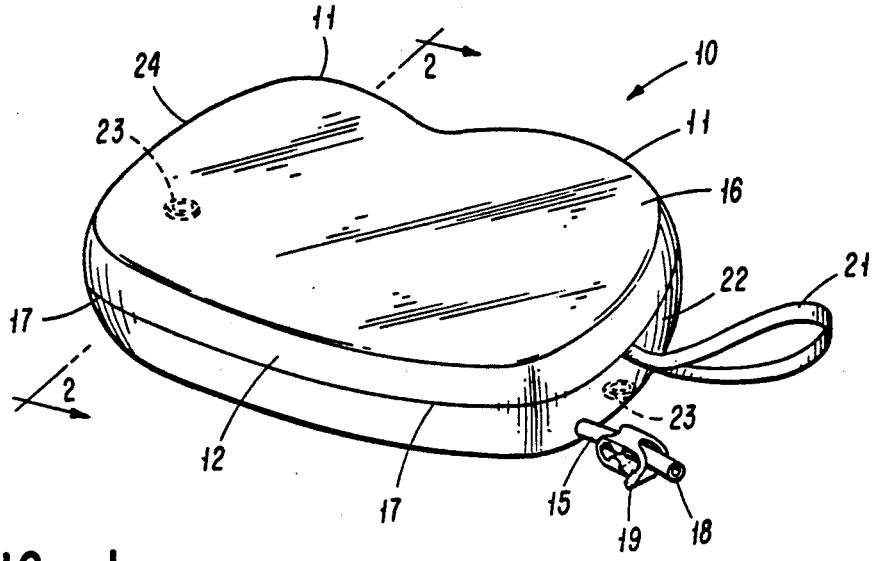
FIG. 1 is an upper perspective view of a seat cushion according to the invention, showing an outer cover, a conduit communicating with the interior of the cushion and a squeeze type closure or for the conduit.

In reference to FIG. 1, a seat cushion 10 is contoured in plan view to support a seated person thereon. A rear edge or rear 11 of the cushion 10 is preferably shaped into a doubly-curved contour, while the front edge or front 12 is essentially straight beneath the person's legs. The size of the cushion 10 is suited to be used on bleachers or stadium seats, having a preferred lateral extent of about one and one-half foot or about sixteen to nineteen inches (approx. 40 to 49 centimeters). The size of the cushion 10 from its front 12 to its rear 11 is preferred to measure approximately one foot or within a preferred range between ten through thirteen inches (approx. 26 to 33 centimeters). A thickness range of one and one-half to two inches (approx. 3 to 5 centimeters) of the cushion 10 has been found to be most satisfactory. It is of course possible to provide a cushion 10 with different dimensions and, hence, of a smaller or larger size. However, it has been found that an optimum seating comfort is effected when, in plan view, the size of the cushion does not extend by any significant amount beyond the person's actual contact area when seated on the cushion. Of course, the contact area may vary somewhat depending on the size and the weight of the person and on the degree of rigidity to which the cushion 10 is adjusted. The comfort of the cushion of preferred size is further mixed with practicality, in that stadium seats, or seats in crowded gyms and swimming pools might prohibit the use of cushions of larger size.

Figure 2:
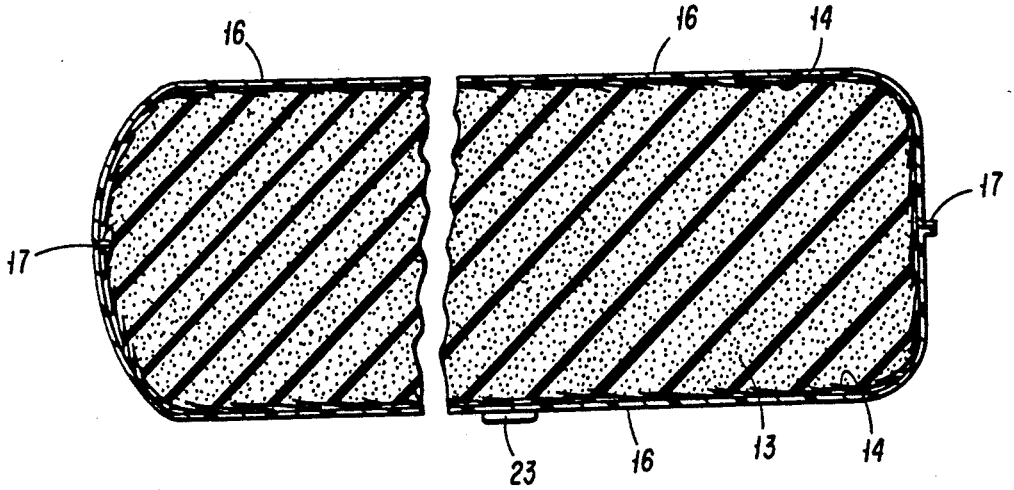
FIG. 2 is a sectional view taken along the line 2—2 of FIG. 1, showing some of the elements interior of the cushion.

Referring to both FIGS. 1 and 2, an innermost element of the cushion, a core 13 gives the cushion 10 its shape when the core 13 is in its uncompressed state, hence when it is fully expanded to its normal lateral dimensions and thickness (such as 1-½ inches, for example). The core 13 is expected to expand with as little restriction as possible to its normal size and shape. In accordance herewith, the core 13 is preferably of an open-celled polyurethane foam material. The core 13 is formed in the overall shape of the cushion 10. No doubt other materials having essentially the same resiliently compressible characteristics of the open-celled polyurethane foam would serve as well. The density of the foam should be low enough so that it is not too rigid, i.e., so that there is not too much foam and too little air, thus impairing its compressibility. Foam may be specified by two numbers which are believed to relate to the compressibility and the weight of the foam. A typical low density specification of an acceptable foam might be 35/1.85, the first number relating to a standard compressibility test, the second number specifying the weight in pounds per cubic foot.

The foam core 13 is hermetically sealed within a thin (for example, 3 mil wall thickness) inner cover 14. The preferred material of the inner cover is polyethylene, but another plastic sheet material, such as vinyl, or PVC material may be substituted therefor. The use of the term "thin" with respect to the material thickness is meant to be a reasonable range of thicknesses with respect to the preferred thickness of 3 mils and having similar characteristics. For an alternate material a different thickness may be appropriate to give similar characteristics as the 3 mil thick polyurethane material. The material of this type is known to be flexible, air-tight, but it does not yield very well resiliently. Thus, if stretched to any extent, the material is found to become permanently stretched and may actually become punctured when subjected to high stresses due to air pressure. The inner cover 14 encloses the inner core 13, and being of an air-tight material, forms an air-impervious envelope about the inner core 13. A person sitting on the cushion would subject the envelope to uneven stresses due to air seeking to expand in directions in which the pressure of the seated person and the counter pressure of the underlying support surface does not prevail.

It appears that to overcome a risk of material failure, the inner core needs to be given an opportunity to relieve concentrated material stresses. A stress relief mechanism may be achieved by choosing a size for the inner cover 14 which is larger than the size of the core 13. Hence, the inner cover 14 fits loosely about the core 13. In a preferred embodiment, the cover would be significantly, possibly between ten to twenty percent larger than the core. It will be apparent that a thicker and stronger material may be chosen for the inner cover, in which case the excess size with respect to the core material to provide for stress relief may not be as critical as with respect to the preferred embodiment described herein. The heavier gauge material for the inner cover 14 also tends to increase weight, cost and deflated stiffness of the cushion 10, while tending to decrease its comfort, ease of folding and, hence, general usefulness.

Hermetic sealing of the inner cover is achieved by well known sealing techniques, such as by bonding or by well-known heat sealing methods. Adjacent a corner of the cushion 10 near its front 12 a short tube 15 exits through the inner cover 14 and through a second, outer cover 16. The outer cover is preferably of a strong, durable material. The material of the outer cover 16 is also flexible, substantially non-yielding and sized to define the outside of the cushion 10. The outer cover 16 may be of, for example, nylon reinforced vinyl, formed preferably of two pieces, an upper and lower cover portion, being sewn together at a seam 17 and substantially enclosing and protecting the inner cover 14. The outer cover 16, preferably of the nylon reinforced vinyl material, also referred to as vinyl covered or impregnated nylon cloth, or of some other cloth material, is also comparatively strong and tear resistant with respect to that of the inner cover 14. The outer cover 16 is substantially of the same size as the outer dimensions of the core 13. As can be seen from the above description, it is the outer cover that gives the shape to the cushion, the cover defining the ultimate outer dimensions of the cushion 10. It has been found advantageous to choose the size of the outer cover 16 to be nominally larger than the core 13, such as no more than about one quarter of an inch along each major axis.

As becomes apparent from the above description, the described relative sizes of the core 13, the inner cover 14 and the outer cover 16 allow the inner cover to shift with respect to the core and outer cover in a space between the core and outer cover. The loosely fitted inner cover 14 is thereby protected from stresses against its material when a person sits on the cushion 10 with an uneven weight distribution, flexing the outer cover 16 and giving the cushion an unevenly formed outer shape. When the weight of the person is then shifted to a different position, the inner cover 14 may again shift with respect to the outer cover 16, rather than being subjected to stresses beyond its yield point due to an uneven load.

Figure 3:
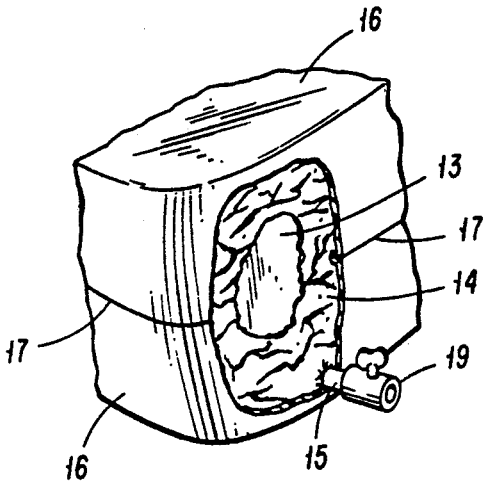
FIG. 3 is a view of a portion of the cushion adjacent the valve but broken away to illustrate further details of the cushion construction, also showing an alternate type of valve.

An external end portion 18 of the tube 15 is fitted with a valve 19 to allow a person to selectively open and close off the tube 15 to atmospheric access to the space within the inner cover 14. The valve 19 may be a cock-type closure, such as shown in FIG. 3, or a squeeze-type closure externally applied to the tube 15, as shown in FIG. 1, where the tube 15 might be of a resilient rubber type material, like that of surgical tubing. In a most simple embodiment, the valve 19 may be a stopper type valve (not shown) at a very end of the tube 15, similar to the type of valves being used on air mattresses, for example. Being located on the side of the cushion 10, adjacent the front 12, the valve 19 is readily operable by one sitting on the cushion to open and close communication of the interior of the inner cover 14, and thus the foam core 13, with the atmosphere.

In one embodiment, the outer cover 16 may further include an outer carrying loop or strap 21, preferably sewn into the seam 17 at a side 22 of the cushion 10. Also, complementary, interlocking buttons or other fasteners 23 may be attached to one of the major surfaces adjacent opposite side surfaces 22 and 24 of the cushion 10. By means of the fasteners 23, the cushion 10 may then be retained in a folded condition after having been deflated and folded along its center and a front-to-rear center folding line.

A typical use cycle of the described cushion 10 may be as follows. The cushion may be initially either folded or unfolded while being carried by the strap 21 to a sporting event or other assembly. The valve 19 is typically closed, sealing the interior space of the inner cover 14 from access to atmospheric air. Atmospheric pressure consequently presses against the inner cover 14, keeping the core 13 in a collapsed state. The volume of the cushion 10, whether folded or unfolded is, hence, at a minimum. When the user has arrived at his or her seat, the valve 19 is simply opened. Air pressure now forces air through the tube 15 into the interior of the inner cover 14, equalizing the pressure on the inner surface and the outer surface of the inner cover 14. As a result, the resilient force of the foam core 13 seeks to expand the foam to its normal, undisturbed shape. As the foam expands, more air rushes into the interior of the inner cover, filling the expanding pores of the core 13 with air and maintaining the pressure within the inner cover substantially equal to atmospheric pressure. When the cushion is fully expanded such that the core 13 fills the volume of the outer cover 16, the user simply closes the valve 19 before sitting down on the cushion 10. In response to the weight of the sitting person, the air within the inner cover 14 compresses slightly, the amount of compression depending, of course on the weight of the person.

With respect to the amount of compression of the cushion 10, it should be realized that the cushion may be compressed totally with a pressure against any small area thereof. In response to such pointed compression, the air within the remaining portion of the inner cover would merely be compressed proportionately. As a result of such selective force application to only a portion of the cushion 10, the foam core most likely would collapse totally. Thus a person stepping on one half of the cushion 10 might indirectly step through to the underlying hard seating surface. On the other hand, a person seating himself or herself on substantially the entire area of the cushion now leaves essentially no or little area without some distributed weight. The air becomes somewhat compressed but the weight of the person is now comfortably supported by the opposed pressure of the air and by further stabilizing support offered by the foam core 13. It is therefore significant that the size of the cushion 10 is substantially of the same size as the contact area of a person seated on the cushion to obtain the best seating comfort from the cushion 10. A person of a smaller frame may use less area of the cushion and find some lateral support, even with full inflation of the cushion 10 in accordance herewith. Hence, the preferred shape as shown in FIG. 1, and the described preferred sizes of the cushion 10 take into account the size and shape of a typical contact area of a person when seated. When the person desires a higher degree of softness from the cushion 10, while being seated, the valve 19 is opened momentarily and then closed again as soon as the desired softness is obtained from air escaping under the weight of the seated person.

When the use of the cushion 10 is no longer desired, and it is desired to deflate the cushion, the valve 19 is simply opened while the user remains seated on the cushion. The foam core now becomes compressed by the weight of the seated person, while the air escapes from the interior space of the inner cover through the tube 15. After the foam core 13 has been sufficiently compressed to collapse the space within the inner cover, the valve 19 is closed and the user may now remove the compressive weight from the cushion 10. Since the valve 19 is closed, atmospheric pressure again retains the cushion 10 in a compressed state.

Though the size of the cushion 10 is ideally as described herein, it may be possible where desired to gang more than one of the cushions into a side by side arrangement. Yet in such an extension, each cushion 10 would be structured and function as the individual cushion 10 described herein. In the case of seat cushions for use at schools, for instance, the two-piece outer cover 16 can be of different colors, those of the various schools, imprinted perhaps with school names, their logos and sobriquets.

Though the invention has been described in terms of a particular embodiment, being the best mode known in carrying out the invention, it is not limited to the embodiment alone. Instead the following claims are to be read as encompassing all adaptations and modifications of the invention falling within its sphere and scope.

It is claimed:

1. A seat cushion comprising:

an inner core of a compressible material having an open cellular structure filled with air when uncompressed, compression of the material expelling air from said structure, the inner core having an uncompressed size and shape of the seat cushion;

an inner cover enclosing the inner core material, the inner cover being of an air-tight material and being sealed, thus hermetically sealing an inner space thereof including the inner core from the atmosphere, the inner cover being of a size larger than the uncompressed size of the inner core and fitting loosely about the inner core;

an outer cover enclosing the inner core and inner cover and being of a size which is smaller than the size of the inner cover, the inner cover being movably disposed between the core and the outer cover, the size and shape of the outer cover defining the outer dimensions of the seat cushion;

a conduit extending through the inner cover and the outer cover and communicating at one end with the interior space of the inner cover and at the other end with the atmosphere; and valve means disposed in the conduit to selectively open and close communication between the interior of the inner cover and the atmosphere, the valve means being operable by a person sitting on the cushion.

2. The cushion of claim 1 wherein the inner core material comprises an open cell polyurethane foam.

3. The cushion of claim 2 wherein the core material is a low density polyurethane foam.

4. The cushion of claim 1 wherein the inner cover is formed of thin sheet polyethylene material; and the outer cover is of a relatively thicker material providing an outer protective cover of durable material enclosing the inner cover.

5. The cushion of claim 4 wherein the inner core material comprises an open cell polyurethane foam.

6. The cushion of claim 5 wherein the core material is a low density polyurethane foam.

7. The cushion of claim 5 wherein the outer cover is of a vinyl impregnated nylon material.

8. The cushion of claim 7 further comprising a carrying strap.

9. A seat cushion comprising:

an inner core of a resiliently compressible material having an open cellular structure of a size substantially of the seat for a person and of predetermined thickness when uncompressed, compression of the inner core under weight of such a person seating thereon capable of expelling air from the core;

an outer cover enclosing the inner core;

an inner cover interposed between the inner core and the outer cover, enclosing the inner core material and being loosely fitted about the inner core, the inner cover being larger in size than the size of the outer cover enclosing the inner cover and of an air-tight material and forming a closed and air impervious envelope about the inner core;

a tube extending through the inner cover and the outer cover and communicating at one end with the interior space of the inner cover and at the other end with the atmosphere; and means for selectively opening and closing off atmospheric access to the space encompassed by the inner cover.

10. The seat cushion of claim 9 wherein the size and shape of the outer cover defines the size and shape of the seat cushion for one person.

11. The seat cushion of claim 9 wherein the tube extending through the inner and outer covers is disposed along the side of the cushion and adjacent a front edge thereof to be accessible to a person seated on the cushion.

12. The seat cushion of claim 11, wherein the means for selectively opening and closing off atmospheric access is a clamp-type valve adjacent an outer end of the tube.

13. The seat cushion of claim 9, wherein the inner core material is a polyurethane foam having an uncompressed thickness in the range of three to five centimeters.

14. The seat cushion of claim 13, wherein the outer cover is of a vinyl impregnated nylon material, the seat cushion further comprising a carrying strap attached to a side of the outer cover.

15. The seat cushion of claim 14 further comprising a pair of laterally oppositely disposed complementary fasteners to attach one side of the cushion to the other when the cushion is folded along its front-to-rear center.

* * * * *